United States Patent [19]

Cooper

[11] 4,074,250

[45] Feb. 14, 1978

[54] ALARM BOX WITH FINGERPRINT RECORDER

[76] Inventor: Stephen Robert Cooper, 246 Sunrise Hill Court, Norwalk, Conn. 06851

[21] Appl. No.: 680,845

[22] Filed: Apr. 27, 1976

[51] Int. Cl.[2] ..... G08B 29/00

[52] U.S. Cl. ..... 340/304; 340/407; 340/149 A

[58] Field of Search ..... 340/304, 407, 149 A; 118/31.5

[56] References Cited

U.S. PATENT DOCUMENTS

| | | | |
|---|---|---|---|
| 3,584,958 | 6/1971 | Miller et al. | 118/31.5 UX |
| 3,940,795 | 2/1976 | Lemelson | 340/149 A |
| 3,986,184 | 10/1976 | Castanino et al. | 340/304 |

*Primary Examiner*—Harold I. Pitts
*Attorney, Agent, or Firm*—Gottlieb, Rackman & Reisman

[57] ABSTRACT

An alarm box for summoning police and/or fire personnel to the scene of an emergency. The alarm box is provided with means for obtaining and recording the fingerprints of the operator, thus deterring the improper use of the alarm box by unauthorized persons. Simultaneously with the transmission of an alarm, at least one of the fingerprints of the operator is obtained and recorded. The alarm box is also provided with transmission means for transmitting a facsimile of the fingerprint or fingerprints obtained to the central station or dispatcher, thereby facilitating and insuring identification of an unauthorized user.

10 Claims, 4 Drawing Figures

FIG. 1
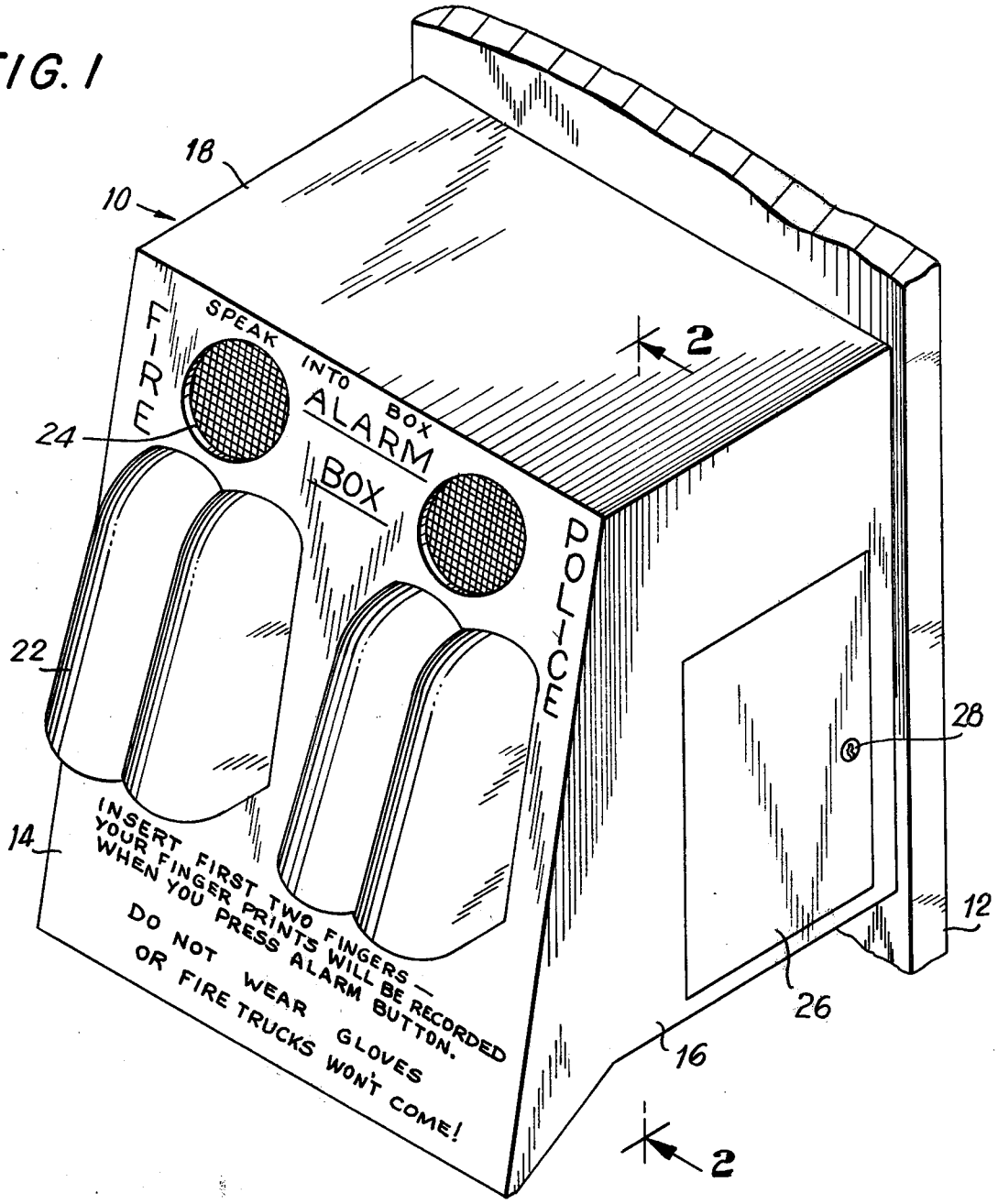
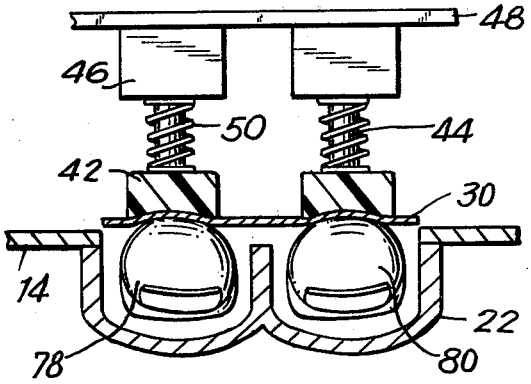
FIG. 4

ALARM BOX WITH FINGERPRINT RECORDER

BACKGROUND OF THE INVENTION

This inventon relates generally to alarm boxes, and more specifically, to an alarm box which incorporates a mechanism for determining the identity of the sender of a false alarm.

Most municipalities, in order to provide better police and fire protection for their citizens, have placed alarm boxes, which are connected to either the police or fire departments, at numerous locations on their streets. Generally, one set of alarm boxes is provided for summoning the police, while a different set of alarm boxes is used to summon fire fighters to the scene of an emergency. These alarm boxes are operated by means of a handle which must be pulled or turned, or by buttons which must be pushed, thereby closing a circuit which activates an alarm at a nearby local station or at a central headquarters.

A recent improvement in this art involves a slightly larger composite alarm box which can be used to summon either the police or the fire department, or both, and which, as an additional feature, permits the sender of the alarm to communicate by voice with the dispatcher in order to inform him of the exact nature of the emergency. Such voice call boxes have recently been placed into use in New York City and elsewhere.

Since the procedure involved in turning in an alarm is relatively simple, it has become apparent that unauthorized persons, including children, are capable of operating and have operated alarm boxes although no real emergency exists. In recent years, the tremendous increase in the number of such false alarms which have been turned in has resulted in a considerable waste of both the time and energy of police and fire personnel. In addition, many deaths and injuries have occurred as a result of the fact that the only available rescue personnel were engaged in answering a false alarm and were therefore not available to render the appropriate aid at the scene of a real emergency.

Various attempts to discourage false alarms have been made in the past. The prior art alarm boxes which also contain detection devices fall generally into one of three categories: those which make a permanent record of the identity of the sender, those which alert passersby, and those which involve some sort of physical apprehension of the sender. An example of the first category is U.S. Pat. No. 1,861,243, where an arrangement was proposed in which two photographs of the sender of the alarm are taken immediately after the alarm is turned in. Two cameras, which are mounted on poles and are located on opposite sides of the alarm box and at some distance away, are operated electrically by a circuit which is closed when the alarm signal is activated. However, the caller can easily escape detection by placing some obstruction in front of the camera lenses or by covering or obscuring his features.

U.S. Pat. No. 3,531,794 is representative of the second category of prior art detection devices, and requires the sender to open a door on the front of the alarm box, thereby automatically activating a flood light and a local siren. An initial alarm is also registered with the central station. The operator must then wait until a time-delay circuit disconnects the local alarm, and allows him access to a switch for sending a secondary alarm, which confirms to the fire personnel that a real emergency exists. However, positive identification is never assured, and a vandal intent upon transmitting a false alarm will probably send in the secondary call as well. U.S. Pat. No. 3,877,005 discloses a similar device which is subject to the same drawbacks.

The third category of prior art devices is shown in U.S. Pat. Nos. 2,301,989 and 2,121,206. In both of these, the sender is required to insert his hand into the box in order to turn in an alarm, but upon activating the signal mechanism, his wrist is automatically entrapped by a removable handcuff which is initially positioned within the box. The sender may then remove his arm from the box in order to return to the emergency, but the handcuff assembly, which is detachable from the box, remains secured to his wrist. The police or fire personnel, who have the key needed to remove the handcuff, may subsequently identify the operator of the alarm box by this distinctive wrist marker. Although the sender of a false alarm would theoretically have to report to the authorities in order to have the handcuff removed, the lock could readily be "picked" and there are, of course, other methods for removing handcuffs which do not require a key.

In summary, the prior art has failed to develop an alarm box, containing a mechanism which deters the transmission of false alarms, which successfully combines both ease and simplicity of operation by authorized users, with a reliable detection system for accurate identification of senders of spurious alarms.

It is therefore the principal object of this invention to provide an alarm box for summoning both police and fire personnel, which also has facilities for accurately identifying the caller or operator of the box.

Another object of this invention is to provide an alarm box for summoning either police or fire personnel which is easily operable and permits expeditious transmission of an alarm.

It is a further object of this invention to provide an alarm box for summoning either police or fire personnel which will prevent and deter unauthorized use by requiring the user to provide a permanent identification record of himself as an integral part of the alarm process.

SUMMARY OF THE INVENTION

Briefly, in accordance with the principles of this invention, a voice call alarm box is provided with means for obtaining and recording the fingerprints of the operator of the box. Such means includes a continuous supply of paper contained within the box and disposed so as to pass between the fingers of the operator and the buttons which the operator must push in order to activate an alarm. The alarm box has finger insertion guides which require the operator to use his fingers in order to turn in an alarm, as well as inking means for applying a dark coloring agent, such as ink or the like, to the fingers of the operator. In the preferred embodiment, the inking means includes an ink reservoir, a transfer roller, and an applicator roller brush. As the operator inserts his fingers into the finger insertion guides, the rollers are rotated, and a layer of the inking substance is thereby transferred to his fingertips. In order to push the alarm buttons, the operator must insert his fingers to the greatest extent permitted by the finger insertion guides, and as the alarm buttons are pushed, the fingerprints of the operator are automatically impressed upon the paper.

Transmission means is also provided for transmitting a facsimile of the fingerprints of the operator to a central station, and includes a suitably adapted miniaturized telecopier, and means to advance the continuous paper supply into and out of the telecopier. The alarm box also has conventional transceivers to permit voice communication between the operator and the dispatcher at a central station.

It is therefore a feature of an embodiment of this invention that an alarm box is provided with a continuous paper supply wound within the box so that a portion thereof is interposed between the call buttons which activate the alarm and the fingers of the operator.

Another feature of an embodiment of this invention is that an alarm box includes a self-contained ink supply and an ink applicator positioned so that the fingers of the operator contact the applicator and are inked thereby, immediately prior to touching the alarm buttons.

Still another feature of an embodiment of this invention is that an alarm box is provided with a modified telecopier for transmission of a facsimile of the fingerprints of the operator to a central station.

BRIEF DESCRIPTION OF THE DRAWINGS

Further objects, features and advantages of this invention will become more readily apparent from an examination of the following specification, when taken in conjunction with the accompanying drawings, wherein:

FIG. 1 is a perspective view of an alarm box containing a preferred embodiment of this invention;

FIG. 4 is a top cross-sectional view of the callbuttons and finger-insertion area, taken along lines 4—4 of FIG. 3 in the direction of the arrows.

DESCRIPTION OF THE PREFERRED EMBODIMENT

Figure 2:
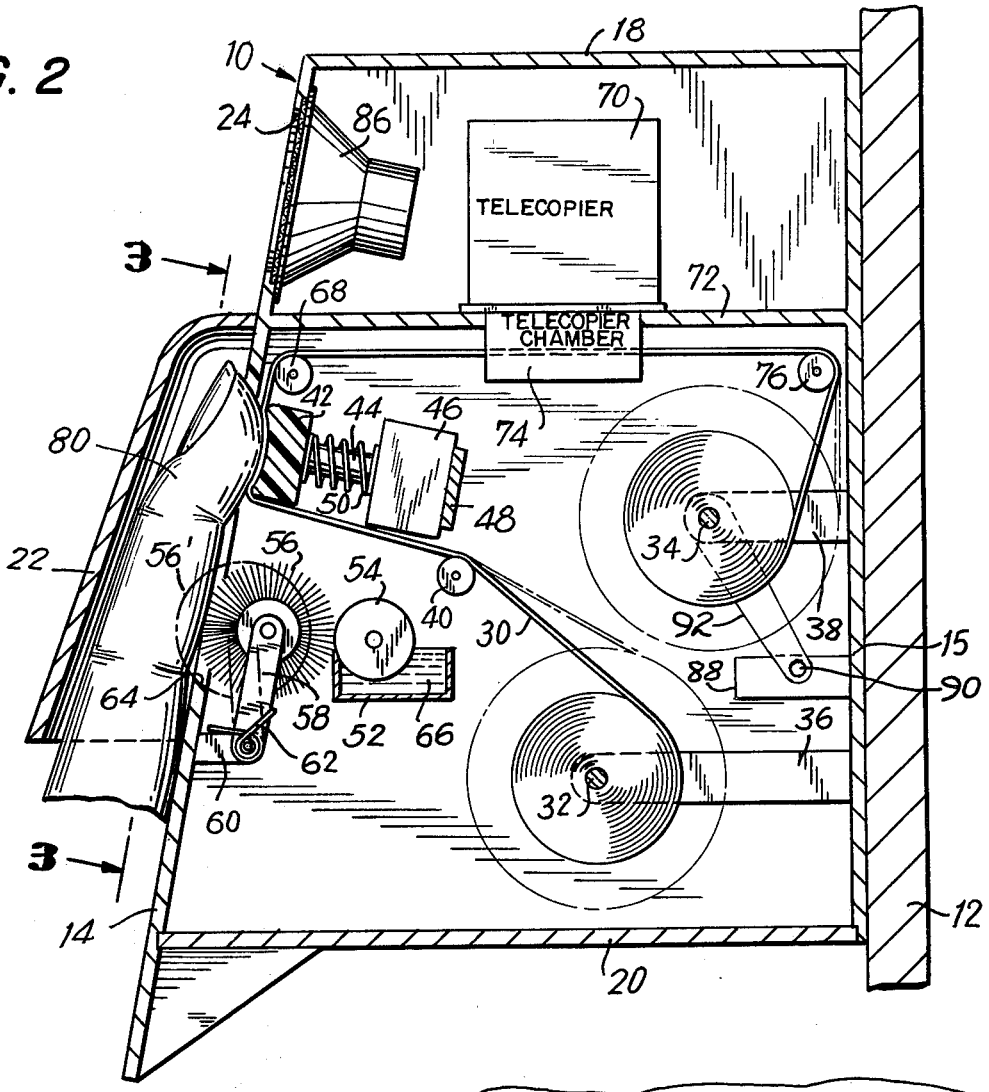
FIG. 2 is a side cross-sectional view of the interior of the alarm box with an illustrative finger shown in operating position, the view being taken along lines 2—2 of FIG. 1 in the direction of the arrows.

Referring now to the drawing, and specifically to FIGS. 1 and 2, an alarm box embodying the principles of the present invention is generally designated 10. Alarm box 10 is attached in a conventional manner to a mounting member, such as panel 12, which may be secured to a wall or utility pole (not shown) in a customary manner. The alarm box also may be mounted directly to the ground.

Alarm box 10 has a housing comprising a rearwardly inclined front wall 14, a vertical rear wall 15, upstanding side walls 16, a top wall 18, and a bottom wall 20. Finger-insertion guides 22 are secured to front wall 14, which is also provided with talk-through apertures 24. In order to provide access to the interior of alarm box 10 (e.g., for service personnel, inspectors, etc.), each side wall 16 is provided with a door 26. The door 26 is equipped with a lock (not shown) and a keyway 28 for insertion of an appropriate key to operate the lock.

In the preferred embodiment of this invention, alarm box 10 can be used to summon either police or fire personnel independently, and therefore, separate but substantially identical means for recording the fingerprints of the operator of the police alarm and fire alarm are provided, the arrangement of parts shown in FIG. 2 being typical. The recording means includes paper strip 30, which is initially wound on supply roller 32, and is transported by the leading end thereof being engaged by a take-up roller 34 in a conventional manner (not shown). In the preferred embodiment, paper 30 may be pre-treated so as to increase its ability to recieve and record fingerprints. Rollers 32, 34 are journaled for rotational movement in brace members 36, 38 respectively, which are secured to the interior of rear wall 15.

Figure 3:
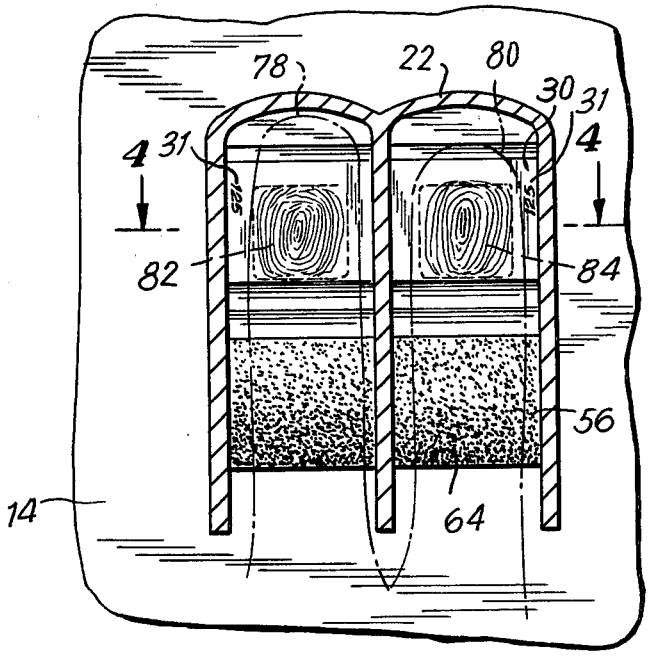
FIG. 3 is an enlarged cross-sectional view of the finger-insertion portion on the front of the alarm box, taken along lines 3—3 of FIG. 2 in the direction of the arrows.

Referring now to FIGS. 3 and 4 in addition to FIGS. 1 and 2, paper 30, in being transported from supply roller 32 to take-up roller 34, passes first around idler roller 40 and then in front of call buttons 42, where it is arranged to receive the fingerprints of the sender of the alarm as he pushes call buttons 42.

As shown in FIGS. 2 and 4, each call button 42 has a slightly concave shape, and is mounted at one end of connecting shaft 44. The other end of connecting shaft 44 extends into a micro-switch 46 of conventional design, which is mounted on support element 48. Call button 42 reciprocates between an inoperative position, shown in FIGS. 2 and 4, and an operative position (not shown) in which connecting shaft 44 is extended further into micro-switch 46, thereby activating micro-switch 46 in the customary manner. Call buttons 42 are biased to their inoperative positions by a coiled compression spring 50 disposed about connecting shaft 44 between call buttons 42 and switch 46.

The aforesaid recording means further includes inking apparatus, which, in the preferred embodiment, comprises and ink reservoir 52, a transfer roller 54, and an applicator roller brush 56 which is mounted for rotational movement on brace member 58. Brace member 58 is pivotally secured to support 60, which is attached to the inner surface of front wall 14 of alarm box 10. Biasing means, such as leaf spring 62, urges brace member 58 towards front wall 14, thereby normally biasing roller brush 56 into contact with beveled abutment 64 of front wall 14; this position of roller brush 56 is shown by phantom lines 56 in FIG. 2. Reservoir 52 is adapted to contain a supply of ink 66, but it will be appreciated that other suitable identifying substances, such as grease or graphite, can be used. Ink supply 66 may contain, in addition to the ink or other coloring agent, any one of a number of well-known ingredients which will depress the freezing point of the ink so as to prevent freezing of the ink during cold weather.

As best shown in FIG. 2, the identifying substance or coloring agent is transferred from reservoir 52 to the fingers of the operator by the cooperation of transfer roller 54 and applicator roller brush 56. When the caller operates call buttons 42, by pushing them, a portion of the coloring agent in fingerprint form is transferred from his fingers to paper strip 30.

Afer receiving the fingerprints of the operator of the alarm box, paper strip 30 passes around idler roller 68 and into a transmission device. In the preferred embodiment of this invention, the transmission device includes a telecopier 70, such as an appropriately modified version of the Model 400 Telecopier, available from the Xerox Corporation of Rochester, N.Y. Telecopier 70, which is supported on interior cross-piece 72, has a downwardly depending chamber 74 adapted to engage paper 30 as it leaves idler roller 68 on its travel toward take-up roller 34. In addition to miniaturization of components, the Xerox Model 400 telecopier previously mentioned requires additional modification in order to provide the configuration of parts shown in FIG. 2. Specifically, a stylus capable of moving both perpendicular and parallel to the direction of movement of paper strip 30 is substituted for the drum of the Model 400 telecopier. After passage through telecopier 70, paper 30 passes around idler roller 76 and is wound onto take-up roller 34.

The aforesaid transmission means further includes drive means for advancing paper 30 along the path which it describes within alarm box 10. In the preferred embodiment, the drive means includes an electric motor 88, the drive shaft 90 of which is linked by drive belt 92 to take-up roller 34.

In actual operation, if it is desired to send an alarm, the operator of alarm box 10 inserts two fingers 78, 80, preferably the index and middle fingers of either hand, into finger-insertion guides 22. Guides 22, which act as shields for buttons 42 to prevent inadvertent activation of alarm box 10, also serve to constrain the movement of the fingers of the operator so that they must contact roller brush 56 with sufficient force to overcome the action of leaf spring 62. As the operator's fingers are inserted into guides 22 and slide upward therein, roller brush 56 is simultaneously rotated in a clockwise direction and is pressed against transfer roller 54. Continued rotation of roller brush 56 causes further rotation of transfer roller 54, and a layer of ink from ink supply 66 is deposited on roller 54. As roller 54 and roller brush 56 make tangential contact, ink is transferred from the surface of roller 54 to roller brush 56, and in turn to fingers 78, 80. As the operator advances his fingers towards the position shown in FIG. 2, a layer of the inking substance is thereby applied to his fingertips.

Only by inserting his fingers to the greatest extent permitted by guides 22 (see FIGS. 2, 3) can the operator reach and operate call buttons 42. As the operator pushes call buttons 42, his fingerprints 82, 84 are simultaneously impressed upon paper 30 by virtue of the prior deposition thereon of ink from roller brush 56. The slightly concave shape of call buttons 42 permits a somewhat larger fingerprint to be obtained than would otherwise be the case if call buttons 42 were flat. The likelihood of identifying the sender of the alarm is thereby increased. For further identification and storage, digits or other identifying index numbers such as 31 in FIG. 3 may be used adjacent to fingerprints 82, 84 for subsequent matching purposes.

Activation of switches 46 by call buttons 42 causes an alarm signal to be transmitted along transmission lines (not shown) to the central police or fire station, and also closes a circuit permitting two-way voice communication between the operator of the alarm box and the central station, for example through transceiver 86. Simultaneously, the drive means advances paper 30 sufficiently along its path so that fingerprints 82, 84 are carried into chamber 74 of telecopier 70, and the action of telecopier 70 is initiated. During the time interval required to transmit the facsimile of the fingerprints, the caller can use the voice channel to advise the dispatcher as to the nature or whereabouts of the emergency. Upon transmission of a clear set of fingerprints (along with, for example, identifying numbers 31 which may be preprinted on paper 30), the appropriate personnel can be dispatched to the scene. If the fingerprints are unclear, either because the operator is wearing gloves or for some other reason, the dispatcher can request the caller to push call buttons 42 again, causing another set of fingerprints to be recorded and transmitted. If no real emergency exists, the transmitted fingerprints of the sender of the false alarm can be segregated by the dispatcher, using the identifying number 31 on paper 30; identification of the caller can then be ascertained through conventional fingerprint-matching techniques. In addition, a permanent record of the fingerprints of every operator of alarm box 10 is stored on the paper 30 as it accumulates on take-up roller 34.

It may be seen from the foregoing that the embodiment described herein is by way of illustration and not of limitation, and that various changes in and other modifications of the construction, composition, and arrangement of parts are possible in light of the above teachings. For example, alarm box 10 could be constructed so that, at the manufacturer's option, the paper containing the fingerprints of the operators of the police alarm would bypass the telecopier and be wound directly onto a take-up roller. This modification would be desirable in those cities or portions of cities where false police alarms occur much less frequently than false fire alarms. Accordingly, it is to be understood that other embodiments of this invention may be utilized without departing from the spirit and scope of the present invention, as set forth in the appended claims.

What is claimed is:

1. A voice call alarm box comprising:
(a) a housing,
(b) circuit means contained within said housing for activation of an alarm at a remote location,
(c) switch means for selection activation of said circuit means,
(d) voice transmission means disposed within said housing for establishing oral communication between each successive operator of said alarm box and said remote location,
(e) means cooperating with said switch means for obtaining and preserving at least one fingerprint of said each successive operator, and
(f) means for transmitting a facsimile of said at least one fingerprint to said remote location.

2. A voice call alarm box in accordance with claim 1 wherein said cooperating means includes
(a) applicator means for applying an identifying substance to at least one finger of said each successive operator, and
(b) recording means disposed within said housing for preserving thereon said at least one fingerprint of said each successive operator.

3. A voice call alarm box in accordance with claim 2 wherein said recording means includes a paper strip disposed for movement along a path from a supply position to a storage position, said path including a recording position at said switch means at which said at least one fingerprint is received and a transmission position at said means for transmitting at which the facsimile of said at least one fingerprint is transmitted.

4. A voice call alarm box in accordance with claim 3 wherein said means for transmitting includes a telecopier and drive means for advancing said paper strip along said path.

5. A voice call alarm box in accordance with claim 4 wherein said switch means includes at least one call button and said circuit means is only activated in response to the operation of said call button.

6. A voice call alarm box in accordance with claim 5 wherein said paper strip is disposed adjacent to said at least one call button to define said recording position, said at least one fingerprint of said each successive operator being impressed upon said paper strip at said recording position when said at least one call button is operated.

7. A voice call alarm box in accordance with claim 6 wherein said applicator means includes a reservoir containing a supply of said identifying substance, a transfer roller partially submerged within said reservoir to selectively pick up said identifying substance, and a roller brush mounted on said housing and disposed for movement toward and away from a tangential contact position with said transfer roller.

8. A voice call alarm box in accordance with claim 7 wherein said housing further includes means for limiting access to said switch means, including an entrance guide for accommodating the finger of said each successive operator, said at least one call button and said recording position being disposed at the inner end of said guide and accessible only therethrough.

9. A voice call alarm box in accordance with claim 8 wherein said entrance guide defines an access channel for said at least one finger, including an opening in said housing to expose said roller brush with said identifying substance thereon, said roller brush obstructing said channel to require said at least one finger to receive said identifying substance before activating said at least one call button at said inner end of said guide.

10. A voice call alarm box in accordance with claim 9 wherein said paper strip includes a plurality of identifying indicia to correspond to each said at least one fingerprint received at said recording position.

* * * * *